US011698206B2

(12) United States Patent
Aoki et al.

(10) Patent No.: US 11,698,206 B2
(45) Date of Patent: Jul. 11, 2023

(54) CONTROLLER FOR AIR CONDITIONER

(71) Applicant: DENSO WAVE INCORPORATED, Aichi-pref. (JP)

(72) Inventors: Shunya Aoki, Chita-gun (JP); Toru Hattori, Chita-gun (JP)

(73) Assignee: DENSO WAVE INCORPORATED, Aichi-Pref. (JP)

( * ) Notice: Subject to any disclaimer, the term of this patent is extended or adjusted under 35 U.S.C. 154(b) by 0 days.

(21) Appl. No.: 17/588,453

(22) Filed: Jan. 31, 2022

(65) Prior Publication Data

US 2022/0307721 A1 Sep. 29, 2022

(30) Foreign Application Priority Data

Mar. 26, 2021 (JP) ..... 2021-053398
Mar. 26, 2021 (JP) ..... 2021-053401

(51) Int. Cl.
*F24F 11/89* (2018.01)
*F24F 110/10* (2018.01)

(52) U.S. Cl.
CPC ..... *F24F 11/89* (2018.01); *F24F 2110/10* (2018.01)

(58) Field of Classification Search
CPC ..... F24F 11/89; F24F 2110/10
USPC ..... 62/129
See application file for complete search history.

(56) References Cited

U.S. PATENT DOCUMENTS

2021/0310685 A1 10/2021 Kanematsu et al.
2021/0349485 A1* 11/2021 Ng ..... F24F 11/30

* cited by examiner

*Primary Examiner* — Nael N Babaa
(74) *Attorney, Agent, or Firm* — Oliff PLC

(57) ABSTRACT

A controller according to an embodiment of the present disclosure is a controller for an air conditioner that performs air-conditioning according to room temperature, the controller comprises: a housing; a heat source temperature sensor disposed inside the housing, the heat source temperature sensor being configured to measure a temperature of a heat source that generates heat during operation as a heat source temperature; an internal temperature sensor disposed inside the housing at a position away from the heat source, the internal temperature sensor being configured to measure a temperature inside the housing as an internal temperature; and a control unit that determines the room temperature using a temperature difference between the measured heat source temperature and the measured internal temperature.

5 Claims, 11 Drawing Sheets

| | HEAT SOURCE TEMPERATURE IMMEDIATELY AFTER POWER ON | HEAT SOURCE TEMPERATURE IN STABLE PERIOD | HEAT SOURCE TEMPERATURE IN AIR BLOWING STATE | TEMPERATURE DIFFERENCE DURING AIR BLOWING |
|---|---|---|---|---|
| G1 | 73.12 | 88.64 | 82.55 | 6.09 |
| G2 | 68.13 | 85.32 | 79.22 | 6.10 |
| G3 | 67.58 | 84.21 | 78.11 | 6.10 |

| | INTERNAL TEMPERATURE IMMEDIATELY AFTER POWER ON | INTERNAL TEMPERATURE IN STABLE PERIOD | INTERNAL TEMPERATURE IN AIR BLOWING STATE | TEMPERATURE DIFFERENCE DURING AIR BLOWING |
|---|---|---|---|---|
| G1 | 77.30 | 82.96 | 79.55 | 3.41 |
| G2 | 76.95 | 83.59 | 80.12 | 3.47 |
| G3 | 76.33 | 82.63 | 79.11 | 3.52 |

CONTROLLER FOR AIR CONDITIONER

CROSS-REFERENCE TO RELATED APPLICATION

This application is based on and claims the benefit of priority from earlier Japanese Patent Application No. 2021-53398 and No. 2021-53401 filed Mar. 26, 2021, the description of which is incorporated herein by reference.

BACKGROUND OF THE INVENTION

Technical Field of the Invention

The present disclosure relates to a controller for use in controlling an air conditioner.

Related Art

It has been known that a temperature sensor that measures room temperature of a room to be air-conditioned is provided so that an air conditioner is controlled according to the room temperature measured by the temperature sensor. JP 2020-165632 A is an example of the related art.

SUMMARY

In such an air conditioner, the temperature sensor may be provided inside a housing of a controller. In this case, the temperature sensor measures a temperature inside the housing. The housing contains a heat source such as a microcomputer that generates heat during operation. Accordingly, when heat is generated by the heat source during operation, the internal temperature of the housing increases due to the generated heat, and thus a measurement value of the temperature sensor becomes higher than the actual room temperature. Therefore, in a conventional technique, room temperature has been estimated by performing a complicated correction to the temperature measured by the temperature sensor using the assumed amount of heat generation.

However, there are other factors that affect the temperature measured by the temperature sensor in addition to the heat generation inside the housing. That is, there is a factor that changes the internal temperature of the housing independently from the change in room temperature. For example, when an air flow is generated in a room where the controller is provided, the air flow removes heat from the housing. Accordingly, the internal temperature of the housing, that is, the temperature measured by the temperature sensor decreases. As a result, when correction using the same correction value is performed in a state where an air flow is present and a state where an air flow is absent, the correction may be excessive in the state where an air flow is present. Further, it is difficult to accurately determine the room temperature since the measured temperature itself changes between the state where an air flow is present and the state where an air flow is absent and an influence of air flow is practically difficult to accurately recognize.

It is thus desired to provide a controller used for an air conditioner and capable of determining room temperature with high accuracy.

According to an embodiment of the present disclosure, a controller for an air conditioner that performs air-conditioning according to room temperature, the controller comprises; a housing; a heat source temperature sensor disposed inside the housing, the heat source temperature sensor being configured to measure a temperature of a heat source that generates heat during operation as a heat source temperature; an internal temperature sensor disposed inside the housing at a position away from the heat source, the internal temperature sensor being configured to measure a temperature inside the housing as an internal temperature; and a control unit that determines the room temperature using a temperature difference between the measured heat source temperature and the measured internal temperature.

With this configuration, the room temperature is determined using a temperature difference between the heat source temperature and the internal temperature. Accordingly, even when the heat source temperature and the internal temperature are subjected to an influence of a change in temperature of the housing caused by a factor other than a change in room temperature, the room temperature can be accurately obtained by removing the influence.

Further, the control unit determines an amount of increase in the internal temperature caused by an influence of heat generated by the heat source relative to the room temperature using a temperature difference between the heat source temperature and the internal temperature, and determines room temperature using the determined amount of increase. With this configuration, even when the heat source temperature and the internal temperature themselves change due to a change in the room temperature or the presence or absence of air flow, the room temperature can be obtained. Therefore, the room temperature can be appropriately obtained according to the environment where the controller is actually installed, or according to the situation in which the room temperature changes or the target temperature instructed to the air conditioner changes to thereby change the room temperature.

Further, the control unit determines an amount of increase in the internal temperature using an influence coefficient and a temperature difference between the heat source temperature and the internal temperature, the influence coefficient being obtained in advance as a ratio of a temperature difference between a heat source temperature measured at a known room temperature and the known room temperature to a temperature difference between an internal temperature measured at the known room temperature and the known room temperature. With this configuration, it is not necessary to perform a complicated calculation, and, even when the heat source temperature and the internal temperature themselves change due to the presence or absence of air flow, the room temperature can be appropriately obtained according to the situation in which the room temperature changes or the target temperature changes to thereby change the room temperature.

Further, room temperature determined using the influence coefficient is within a temperature range regarded as room temperature. With this configuration, the air conditioner can be operated based on an appropriate room temperature.

DETAILED DESCRIPTION OF THE PREFERRED EMBODIMENTS

Figure 1:
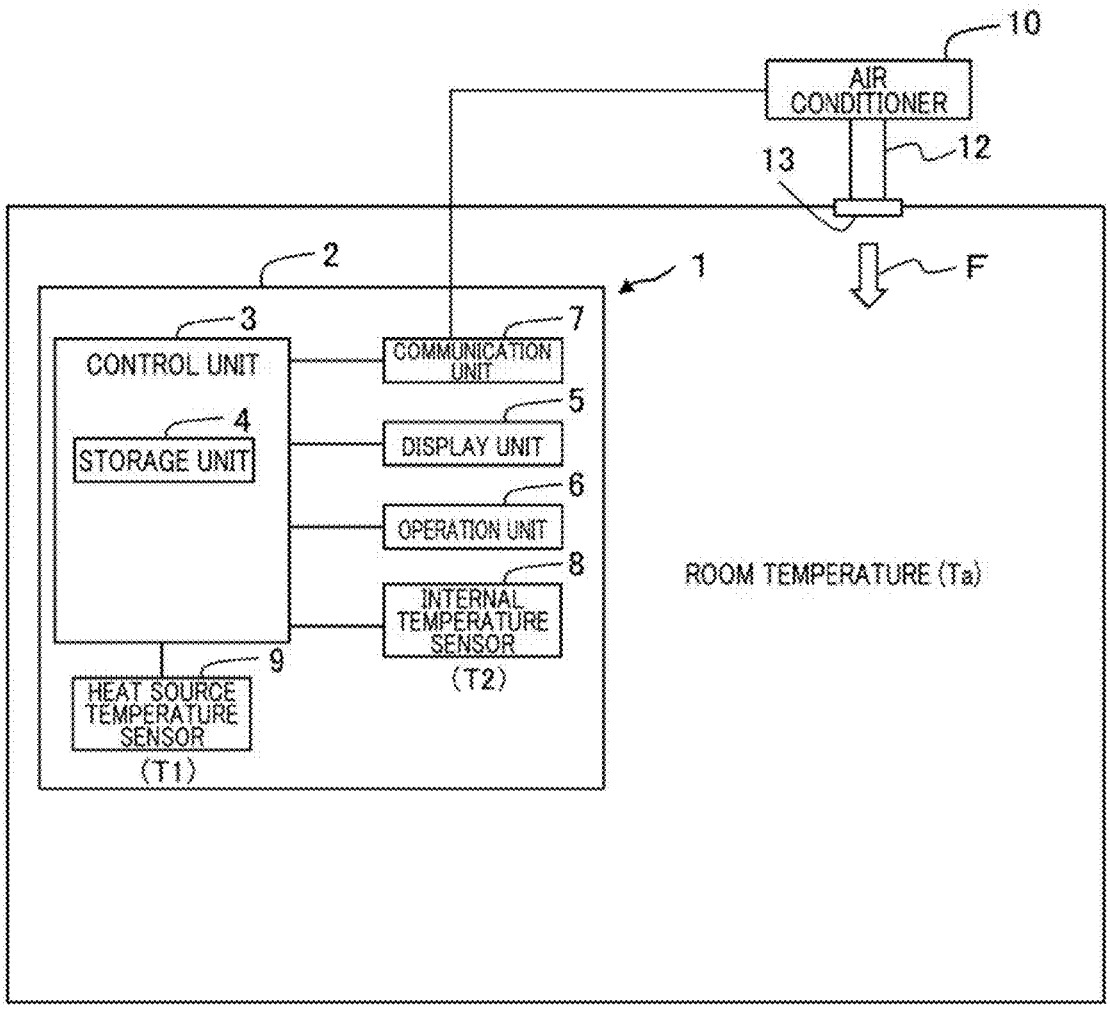
FIG. 1 is a diagram schematically illustrating an example configuration of a controller according to a first embodiment.

With reference to the drawings, a plurality of embodiments will be described below. Throughout the embodiments, the same reference numerals are used to refer to substantially the same components.

First Embodiment

As shown in FIG. 1, a controller 1 of the present embodiment includes a housing 2, a control unit 3, a storage unit 4, a display unit 5, an operation unit 6, a communication unit 7, an internal temperature sensor 8, a heat source temperature sensor 9, and the like. The controller 1 is used to set a target temperature for an air conditioner 10 and display a room temperature (Ta). The configuration of the controller 1 shown in FIG. 1 is merely an example, and is not limited thereto.

The housing 2 is formed, for example, in a generally rectangular thin box shape made of a resin material or the like, and is mounted on an installation surface on a wall or the like of a room to be air-conditioned, such as an office or a living room. In the present embodiment, the housing 2 is assumed to have a relatively small size. The relatively small size is assumed to have a side length of, for example, approximately less than 100 mm, and when an air flow occurs around the housing 2, the entire housing 2 is substantially uniformly exposed to the air flow.

Figure 2:
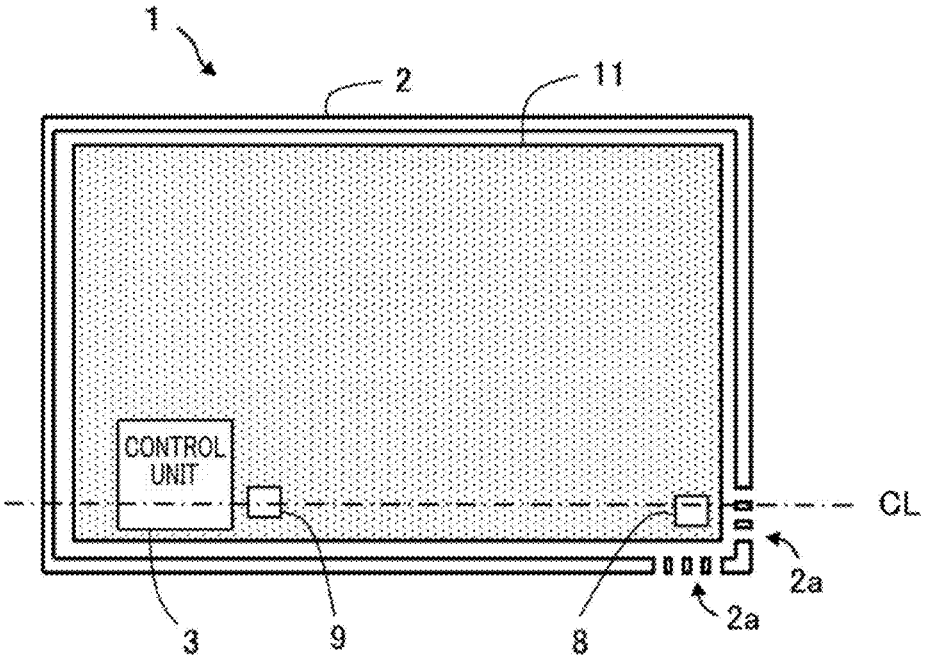
FIG. 2 is a diagram schematically illustrating an example arrangement inside a housing.

As shown in FIG. 2, a substrate 11 is disposed inside the housing 2. On the substrate 11, electrical components such as the control unit 3, the internal temperature sensor 8, the heat source temperature sensor 9, and the like are mounted. In FIG. 2, the substrate 11 is schematically illustrated by hatching. Although other electrical components are not illustrated in FIG. 2 for simplification of description, components such as connectors used in the display unit 5, the operation unit 6, the communication unit 7, or the like are also mounted on the substrate 11.

The control unit 3 comprises a microcomputer including a CPU (central processing unit), a ROM (read only memory), a RAM (random access memory) and the like, which are not shown. The control unit 3 controls the controller 1 by reading and executing programs stored in the storage unit 4. For example, the control unit 3 instructs to start/stop an operation of the air conditioner 10 or instructs a target temperature according to the operation input to the operation unit 6. Furthermore, the control unit 3 determines room temperature as will be described in detail later.

The storage unit 4 may comprises, for example, a non-volatile memory such as a flash memory, and stores programs and various data for controlling the controller 1. Although the storage unit 4 of the present embodiment is built in the control unit 3, it may also be externally attached to the control unit 3. The storage unit 4 stores an influence coefficient (k), which is obtained in advance by a preliminary test, as will be described in detail later.

The display unit 5 is disposed on a front side of the housing 2 in a state of being installed on the installation site. Although not shown in the figure, the display unit 5 comprises a liquid crystal panel capable of displaying, for example, characters and numbers, and a light emitting component such as an LED (light emitting diode) configured to indicate an operation mode.

As with the display unit 5, the operation unit 6 is disposed on the front side of the housing 2, and receives operations such as start/stop of the air conditioner 10, setting and changing of a target temperature, and the like. The operation unit 6 may also comprises, for example, a mechanical switch or a touch panel provided corresponding to a display region of the display unit 5.

The communication unit 7 is communicably connected to the air conditioner 10, and transmits a control signal to the air conditioner 10 to thereby instruct start/stop of the operation of the air conditioner 10 and a target temperature. The communication unit 7 is assumed to use a wired communication system, but may also use, for example, a wireless communication system using infrared light.

The internal temperature sensor 8 comprises a known sensor such as a temperature measuring resistor type, a thermistor type, a thermocouple type, or an integrated circuit type. The internal temperature sensor 8 measures a temperature of a region where the internal temperature sensor 8 is disposed, that is, inside the housing 2. As shown in FIG. 2, the internal temperature sensor 8 is disposed at a position close to the lower right end of the housing 2, that is, at the lower right corner of the housing 2. On the other hand, the control unit 3, which is a heat source that generates heat during operation, is disposed at a position close to the lower left end of the housing 2, that is, at the lower left corner of the housing 2, which is a side opposite to that where the internal temperature sensor 8 is disposed.

In other words, the internal temperature sensor 8 is disposed at a position away from the heat source on a lower side of the housing 2, where the temperature is relatively low when the temperature inside the housing 2 increases. The internal temperature sensor 8 is disposed at a position where it can detect a predetermined significant temperature difference relative to the temperature of the heat source when the heat source generates heat during operation. The position where a significant temperature difference can be detected is determined in advance by a method such as thermal design, taking into consideration the shape and size of the housing 2, arrangement of electrical components in the housing 2, and the like.

Further, a plurality of slits 2*a* that communicate with the outside of the housing 2 are disposed near the internal temperature sensor 8. In the present embodiment, the slits 2*a* are provided at the lower right corner of the housing 2 by forming apertures in the lower wall and the right wall of the housing 2. Accordingly, the internal temperature sensor 8 is likely to be exposed to the air in the room.

Although the internal temperature sensor 8 is disposed near the slits 2*a*, it is located inside the housing 2. Accordingly, it measures the temperature inside the housing 2 which is heated by heat from the heat source. Hereinafter, the temperature inside the housing 2 measured by the internal temperature sensor 8 is also referred to as an internal temperature (T2).

The heat source temperature sensor 9 comprises a known sensor such as a temperature measuring resistor type, a thermistor type, a thermocouple type, or an integrated circuit type. The heat source temperature sensor 9 measures a temperature of the control unit 3, that is, the heat source. Specifically, the heat source temperature sensor 9 is disposed near the control unit 3 or attached to a package of the control unit 3, and directly measures the temperature of the heat source. Hereinafter, the temperature of the heat source measured by the heat source temperature sensor 9 is also referred to as a heat source temperature (T1).

The heat source temperature sensor 9 is disposed between the control unit 3, which is a heat source in the present embodiment, and the internal temperature sensor 8 at a position closer to the heat source than to the internal temperature sensor 8. In this case, the heat source temperature sensor 9 can be positional on a virtual line (CL) passing through the control unit 3 and the internal temperature sensor 8 or within a predetermined range from the virtual line (CL). Further, when a temperature sensor is built in the control unit 3, for example, the temperature sensor can be used as the heat source temperature sensor 9.

It is assumed that the air conditioner 10 in the present embodiment is a central heating system which supplies air cooled or heated by the air conditioner 10 through an air blowing port 13 that is open to the inside of the room via a duct 12 as indicated by an arrow F. However, a method of determining room temperature in the present embodiment can also be applied to air conditioners comprising an outdoor unit and an indoor unit. Hereinafter, a state in which air-conditioning operation which generates air flow is performed by the air conditioner 10 is referred to as an air blowing state, and a state in which air-conditioning operation which generates no air flow is performed is referred to as a windless state.

Next, effects of the controller 1 having the above configuration will be described. As described above, the housing 2 contains a heat source such as the control unit 3 that generates heat during operation. Accordingly, when heat is generated by the heat source during operation, the internal temperature of the housing 2 increases due to the generated heat, and thus a measurement value of the internal temperature sensor 8 becomes higher than the actual room temperature. Therefore, in a conventional technique, room temperature has been estimated by performing a complicated correction to the temperature measured by the internal temperature sensor 8 using the assumed amount of heat generation.

Figure 3:
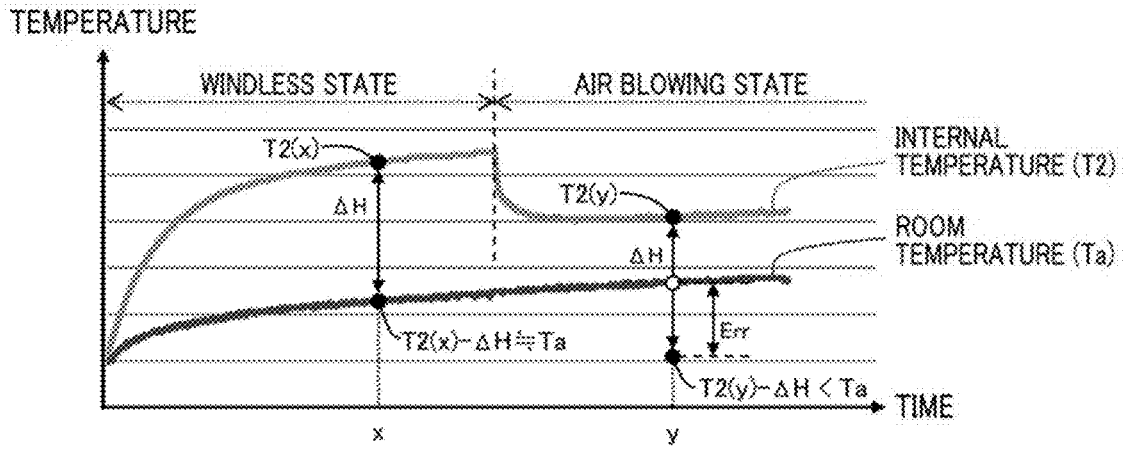
FIG. 3 is a diagram showing an example how a measured temperature changes between a windless state and an air blowing state.

However, there are other factors that affect the temperature measured by the internal temperature sensor 8 in addition to the heat generation inside the housing 2. That is, as shown in FIG. 3, when changing from the windless state to the air blowing state, an air flow is generated in a room where the controller 1 is provided. As the air flow removes heat from the housing 2, the internal temperature (T2) of the housing 2 measured by the internal temperature sensor 8 decreases.

On the other hand, while the air flow is generated, the room temperature (Ta) which is being air-conditioned does not experience a large change compared with the internal temperature (T2). Therefore, in correction of the internal temperature (T2) using a correction value (ΔH) corresponding to the amount of heat generation, a corrected temperature obtained by subtracting the correction value (ΔH) from the internal temperature (T2(*x*)) at a time (x) in the windless state substantially matches the room temperature (Ta). However, at a time (y) in the air blowing state, a corrected temperature obtained by subtracting the correction value (ΔH) from the internal temperature (T2(*y*)) becomes lower than the room temperature (Ta). Thus, an error (Err) occurs between the corrected temperature and the actual room temperature.

That is, when the same correction is performed in the air blowing state as in the windless state, the correction may be excessive. It is possible to recognize whether an air flow is present from the operation mode. However, considering that the amount of heat removed from the housing 2 may vary depending on how air flows, and the size of the place where the controller 1 is installed and the layout of the room may vary, it is difficult to recognize an air flow in the room in advance.

On the other hand, the controller 1 can appropriately determine room temperature without excessive correction in both the windless state and the air blowing state. Further, the controller 1 can determine room temperature without recognizing air flow. Specifically, the controller 1 executes the process shown in FIG. 4 to determine the room temperature (Ta) based on a temperature difference (ΔT) between the heat source temperature (T1) and the internal temperature (T2) measured during operation.

Figure 4:
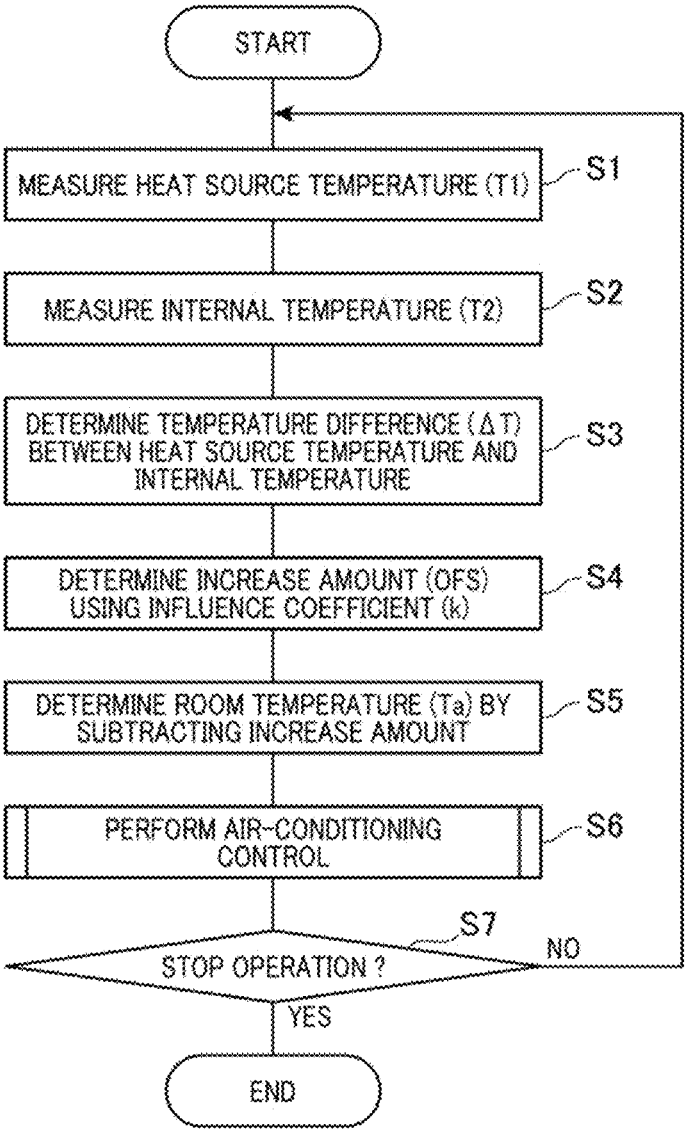
FIG. 4 is a flowchart of a process for determining room temperature.

As shown in FIG. 4, the controller 1 measures the heat source temperature (T1) in step S1, and measures the internal temperature (T2) in step S2. Steps S1 and S2 can be executed in any order. Then, the controller 1 determines the temperature difference (ΔT) between the heat source temperature (T1) and the internal temperature (T2) in step S3, and determines an increase amount (OFS) of the internal temperature (T2) relative to the room temperature using the influence coefficient (k) in step S4. The OFS is an abbreviation of offset.

The influence coefficient (k) is a coefficient defined for determining an influence of heat generated by the heat source on a value measured by the internal temperature sensor 8. In the present embodiment, a preliminary test is performed to obtain the influence coefficient (k) as a ratio of a temperature difference between a heat source temperature measured at a known room temperature and the known room temperature to a temperature difference between an internal temperature and the known room temperature.

Figure 5:
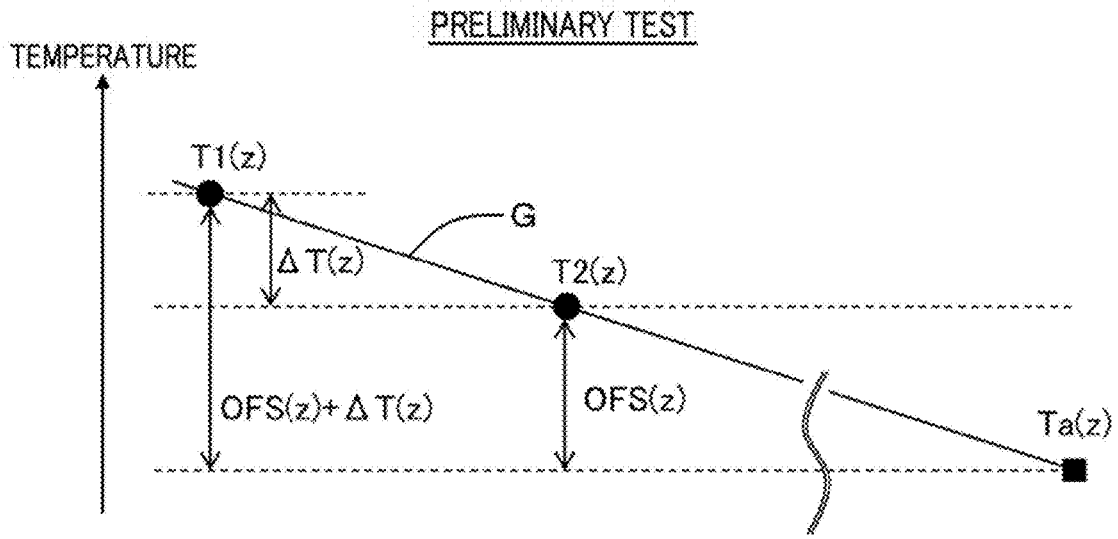
FIG. 5 is a diagram showing how an influence coefficient is calculated.

Specifically, in the preliminary test, the controller 1 is placed under a test environment in which a constant room temperature can be maintained, and measures a heat source temperature and an internal temperature in the windless state. That is, the influence coefficient (k) is obtained in a state where no disturbance is present. In the preliminary test, as shown in FIG. 5, for example, it is assumed that the known room temperature is Ta(z), the measured heat source temperature is T1(*z*), and the measured internal temperature is T2(*z*).

In this case, the relationship among these temperatures is such that the heat source temperature is the highest, the room temperature is the lowest, and the internal temperature is intermediate therebetween. The reason for this is that, although the internal temperature sensor 8 itself does not generate heat, the heat source during operation generates heat, which in turn warms air inside the housing 2, and the temperature of such air is measured by the internal temperature sensor 8. In other words, due to the internal temperature sensor 8 being affected by heat generated by the heat source, the measured internal temperature is higher than the room temperature.

In this case, since a heat flow is directed toward the low temperature side, the room temperature, which is the lowest temperature, is regarded as an end point of the heat flow, that is, a reference point in determining the influence of heat. Further, in the test environment, in which the heat source temperature and the room temperature are constant, the heat flows at a predetermined temperature gradient as indicated by the graph G. When the temperature gradient is constant, the relationship between a temperature difference (OFS(z)+ΔT), which is a difference between the heat source temperature and the room temperature, and a temperature difference (OFS(z)), which is a difference between the internal temperature and the room temperature, can be represented by the following formula (1) using the influence coefficient (k).

$$\mathrm{OFS}(z)+\Delta T(z)=k\times\mathrm{OFS}(z) \quad (1)$$

From the above formula (1), the influence coefficient (k) can be calculated by the following formula (2) using the known room temperature together with the heat source temperature and the internal temperature measured at the room temperature.

$$k=(\mathrm{OFS}(z)+\Delta T(z))/\mathrm{OFS}(z) \quad (2)$$

That is, the influence coefficient (k) can be defined as a ratio of the temperature difference (OFS(z)+ΔT(z)) between the heat source temperature and the room temperature to the temperature difference (OFS(z)) between the internal temperature and the room temperature.

The temperature difference (OFS(z)) between the internal temperature and the room temperature corresponds to the amount of increase in the internal temperature caused by the influence of the heat source. Therefore, the room temperature can be obtained by subtracting the increase amount from the measured internal temperature. That is, the influence coefficient (k) can be obtained in advance to calculate an amount of increase in the internal temperature, that is, a temperature difference between the internal temperature and the room temperature from the heat source temperature and the internal temperature measured during operation, and finally calculate room temperature.

As seen from formula (1), the influence coefficient (k) is a dimensionless quantity. That is, the influence coefficient (k) indicates the relationship between the other parameters in formula (1). Further, while a change in the heat source temperature changes the influence on the internal temperature, it also changes the temperature difference between the internal temperature and the room temperature, that is, the amount of increase in the internal temperature. Specifically, the internal temperature and the increase amount of the internal temperature change with a change in the heat source temperature so that the influence coefficient (k) is maintained. Therefore, even when the temperature gradient changes due to a change in the room temperature or the heat source temperature, the influence coefficient (k) can be used in common. In other words, even when the actual room temperature or the heat source temperature is different from that in the preliminary test, the influence coefficient (k), representing the influence of the heat source on the measurement value of the internal temperature sensor 8, is common.

The reason for this is considered to be that, when the internal structure of the housing 2 remains the same in both the preliminary test and the actual operation, the positional relationship between the internal temperature sensor 8 and the heat source temperature sensor 9 remains the same, and thus heat conduction in the substrate 11 in the housing 2 also remains the same. In addition, when the housing 2 is relatively small and thin as in the present embodiment, it is considered that heat conduction to the outside of the housing 2 caused by an air flow also remains the same. For example, the housing 2 is entirely cooled, rather than partially cooled. As will be described later referring to FIGS. 6 and 7, the controller 1 is found to be capable of appropriately determining the room temperature even when the room temperature or the heat source temperature is different from that in the preliminary test.

The controller 1 obtains an increase amount (OFS) of the internal temperature from the temperature difference between the heat source temperature and the internal temperature in step S4 shown in FIG. 4, and determines room temperature by subtracting the obtained increase amount from the internal temperature in step S5. Then, when an instruction to stop the operation is input to the controller 1 (YES in step S7), the process ends. On the other hand, when an instruction to stop the operation is not input (No in step S7), the controller 1 repeats the steps from step S1 onward.

Figure 6:
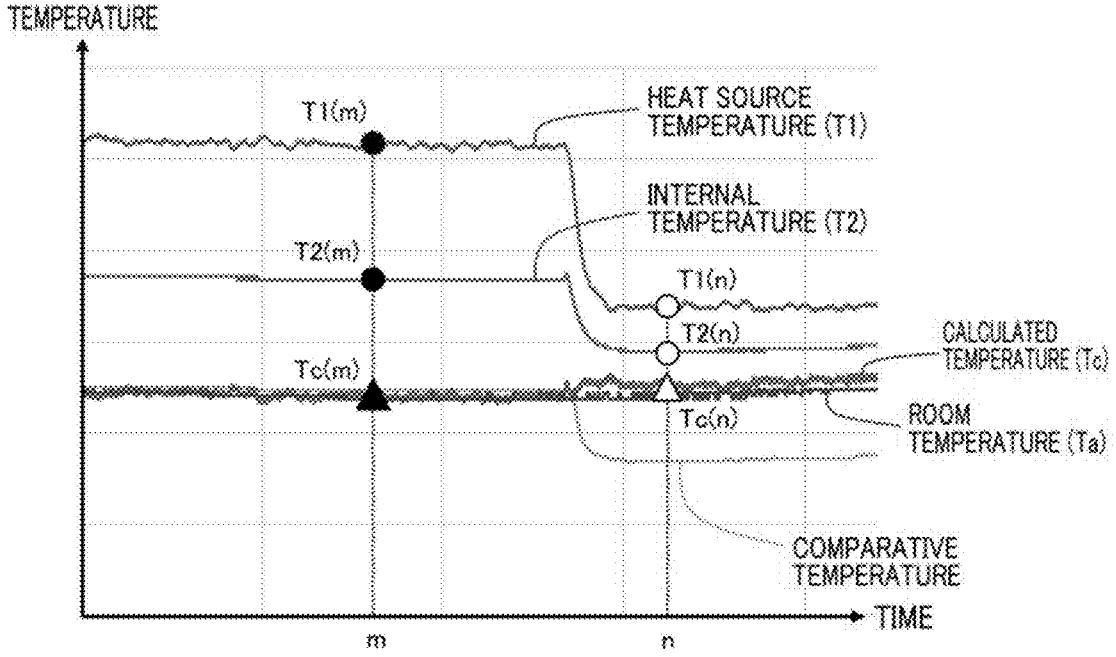
FIG. 6 is a diagram showing an example of a result of calculating room temperature using an influence coefficient.
Figure 7:
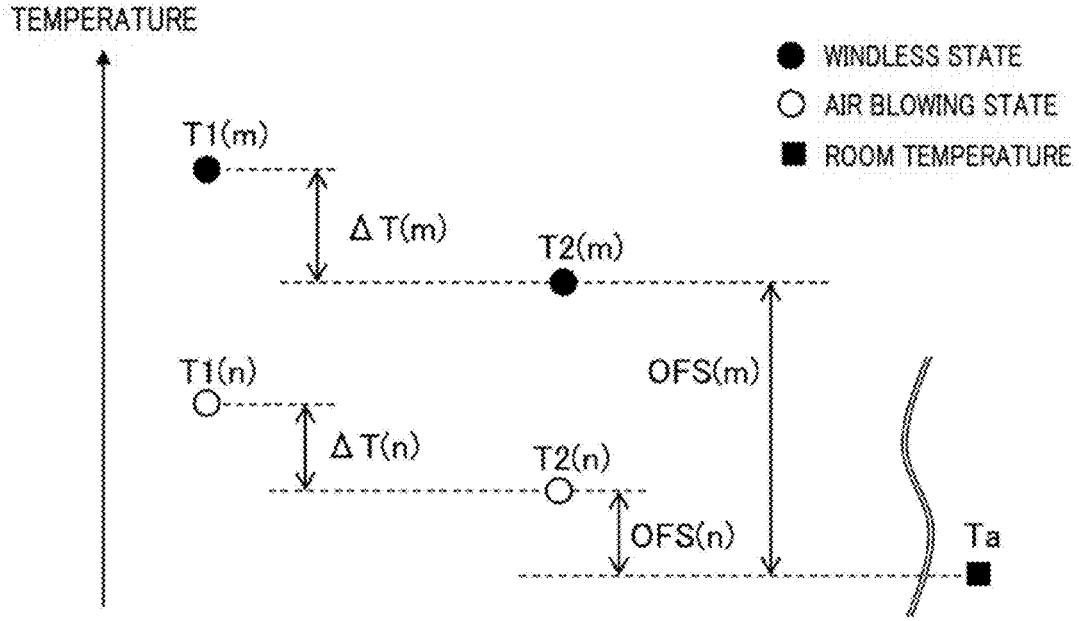
FIG. 7 is a diagram showing another example of a result of calculating room temperature using an influence coefficient.

With reference to FIGS. 6 and 7, the aforementioned process will now be described. First, as indicated by the black circles at a time (m) in the windless state shown in FIG. 6, it is assumed that the heat source temperature and the internal temperature are T1(*m*) and T2(*m*), respectively. In this case, the relationship among the heat source temperature, the internal temperature, and the increase amount (OFS(m)) of the internal temperature shown in FIG. 7 is represented as follows from formula (1).

$$\mathrm{OFS}(m)+(T1(m)-T2(m))=k\times\mathrm{OFS}(m)$$

Since the influence coefficient (k) is obtained in advance and the heat source temperature and the internal temperature are actually measured, these values can be substituted to calculate the increase amount (OFS(m)), that is, the temperature difference between the internal temperature and the room temperature. Then, the room temperature can be obtained by subtracting the increase amount from the measured internal temperature.

When the room temperature thus obtained is referred to as a calculated temperature (Tc), a calculated temperature (Tc(m)) at the time (m) indicated by the black triangle is found to substantially match the actual room temperature (Ta) as shown in FIG. 6. It should be noted that the determination criteria of the substantial match varies depending on the required specifications. In the present embodiment, the above determination criteria may be, for example, a difference between the calculated temperature and the actual room temperature being within 1 degree (Fahrenheit).

Further, as indicated by the white circles at a time (n) in the air blowing state shown in FIG. 6, it is assumed that the heat source temperature and the internal temperature are T1(*n*) and T2(*n*), respectively. In this case, the relationship among the heat source temperature, the internal temperature, and the increase amount (OFS(n)) of the internal temperature shown in FIG. 7 is represented as follows from formula (1).

$$\mathrm{OFS}(n)+(T1(n)-T2(n))=k\times\mathrm{OFS}(n)$$

Since the influence coefficient (k) is obtained in advance and the heat source temperature and the internal temperature are actually measured, these values can be substituted to calculate the increase amount (OFS(n)), that is, the temperature difference between the internal temperature and the room temperature. Then, the room temperature can be obtained by subtracting the increase amount from the measured internal temperature.

When the room temperature thus obtained is referred to as a calculated temperature (Tc), a calculated temperature (Tc(n)) at the time (n) indicated by the white triangle is found to substantially match the actual room temperature (Ta) as shown in FIG. 6. In the present embodiment, it is found that a difference between the calculated temperature and the actual room temperature may be, for example, within 1 degree (Fahrenheit). Further, compared with a comparative temperature obtained by correcting the internal temperature using the aforementioned conventional technique described above with reference to FIG. 3, it is found that the room temperature can be appropriately obtained. In addition, although not shown in the figure, as a result of the same test being performed at a room temperature different from that in FIG. 6, it is found that the room temperature can be appropriately measured using a single influence coefficient (k) obtained by a preliminary test.

Further, the controller 1, when executing the above process, is found to be capable of appropriately determining the room temperature using a single influence coefficient (k) obtained by a preliminary test, within a temperature range regarded as room temperature, and more specifically, within a target temperature range that can be set by the controller 1.

As described above, the controller 1 can obtain a calculated temperature using the same influence coefficient (k) obtained by a preliminary test even when the heat source temperature and the internal temperature change in the windless state and the air blowing state, or even when the room temperature itself changes in the windless state or the air blowing state. A difference between the calculated temperature and the actual room temperature is within 1 degree (Fahrenheit). Thus, the controller 1 is found to be capable of appropriately determining the room temperature.

According to the controller 1 described above, the following effects can be obtained. The controller 1 is a controller for the air conditioner 10 that performs air-conditioning according to room temperature, the controller 1 comprises: a housing 2; a heat source temperature sensor 9 disposed inside the housing 2, the heat source temperature sensor 9 being configured to measure a temperature of a heat source that generates heat during operation as a heat source temperature; an internal temperature sensor 8 disposed inside the housing 2 at a position away from the heat source, the internal temperature sensor 8 being configured to measure a temperature inside the housing 2 as an internal temperature; and a control unit 3 that determines the room temperature using a temperature difference between the measured heat source temperature and the measured internal temperature.

With this configuration, the room temperature is determined using a temperature difference between the heat source temperature and the internal temperature. Accordingly, even when the heat source temperature and the internal temperature are subjected to an influence of a change in temperature of the housing caused by a factor other than a change in room temperature, the room temperature can be accurately obtained by removing the influence.

Further, the control unit 3 determines an amount of increase in the internal temperature caused by an influence of heat generated by the heat source relative to the room temperature using a temperature difference between the heat source temperature and the internal temperature, and determines room temperature using the determined amount of increase. With this configuration, even when the heat source temperature and the internal temperature themselves change due to a change in the room temperature or the presence or absence of air flow, the room temperature can be obtained. Therefore, the room temperature can be accurately obtained according to the environment where the controller 1 is actually installed, or according to the situation in which the room temperature changes or the target temperature changes to thereby change the room temperature.

Further, the control unit 3 determines the amount of increase in the internal temperature using an influence coefficient (k) and a temperature difference between the heat source temperature and the internal temperature, the influence coefficient (k) being obtained in advance as a ratio of a temperature difference between a heat source temperature measured at a known room temperature and the known room temperature to a temperature difference between an internal temperature measured at the known room temperature and the known room temperature. With this configuration, it is not necessary to perform a complicated calculation, and, even when the heat source temperature and the internal temperature themselves change due to the presence or absence of air flow, the room temperature can be appropriately obtained according to the situation in which the room temperature changes or the target temperature changes to thereby change the room temperature.

Further, room temperature determined using the influence coefficient is within a temperature range regarded as room temperature. With this configuration, the air conditioner can be operated based on an appropriate room temperature.

Further, since the internal temperature sensor 8 is disposed at a position away from the heat source, a large temperature difference between the heat source temperature and the internal temperature can be ensured, which improves the accuracy in estimation of the room temperature.

Further, since the heat source temperature sensor 9 is disposed between the heat source and the internal temperature sensor 8, the temperatures measured by the heat source temperature sensor 9 and the internal temperature sensor 8 more accurately reflect the heat flow directed from the heat source toward the outside of the housing 2 via the heat source temperature sensor 9 and the internal temperature sensor 8. This improves the accuracy in estimation of the room temperature.

Second Embodiment

The following description will be given of a second embodiment. The second embodiment is different from the first embodiment in that the heat source temperature used for determining an amount of increase in the internal temperature is corrected. Since the overall configuration and the flow of process by the controller 1 are substantially the same as those in the first embodiment, the following description will be given with reference to FIGS. 1 and 2.

Figures 8A, 8B:
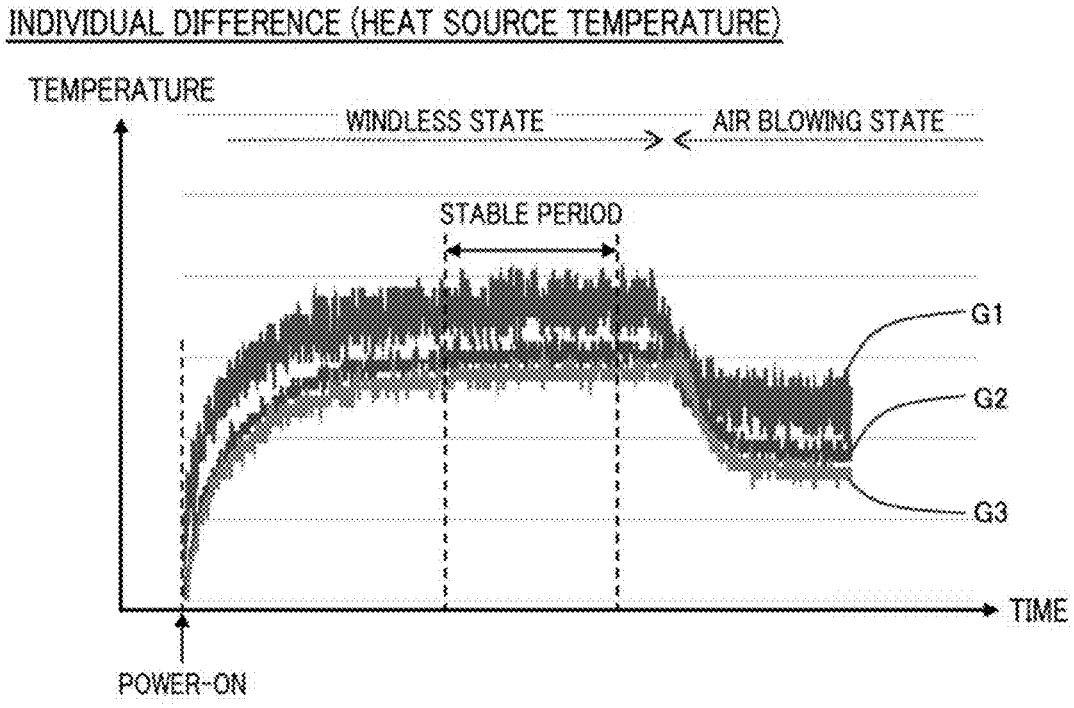
FIG. 8A is a diagram showing an example of individual differences in heat source temperatures according to a second embodiment.
FIG. 8B is a diagram showing an example of individual differences in heat source temperatures according to the second embodiment.

The controllers 1, when they are the same products, are produced using the same types of electrical components. However, there may be individual differences among the electrical components that are used. For example, as shown in FIGS. 8A and 8B, a result of measuring the heat source temperatures of three controllers 1, which are referred to as G1, G2 and G3, under the test environment at the same temperature shows that there is a case where the heat source temperature measured for each controller 1 is different from the other. It should be noted that the measurement result shown in FIG. 8B is merely an example.

For example, the heat source temperatures measured immediately after powering on the controller 1 are found different between G1 and G2 by approximately 5 degrees (Fahrenheit), and between G1 and G3 by approximately 5.5 degrees (Fahrenheit). Further, in a stable period in which the temperature of the controller 1 becomes stable after a certain time has elapsed from the time of power-on and in an air blowing state in which air blowing is started, the heat source temperature of each controller 1 is found different from the other by approximately 3 to 4 degrees (Fahrenheit). In addition, it is also found that the difference immediately after power on and the difference in the stable period or in the air blowing state do not coincide with each other, that is, there are individual differences in heat generation.

On the other hand, it is found that, when a temperature difference between the heat source temperature in the stable period in the windless state and the heat source temperature in the air blowing state is referred to as a temperature difference during air blowing, the temperature difference during air blowing tends to be common among the controllers 1 and is approximately 6.1 degrees (Fahrenheit). The temperature difference during air blowing described above refers to a difference between an average of the heat source temperatures measured during a predetermined period in the stable period and an average of the heat source temperatures measured during a predetermined period in the air blowing state. Although FIGS. 8A and 8B show the measurement results for three controllers 1 for simplicity of illustration, similar tendencies are statistically confirmed in the tests conducted.

Figures 9A, 9B:
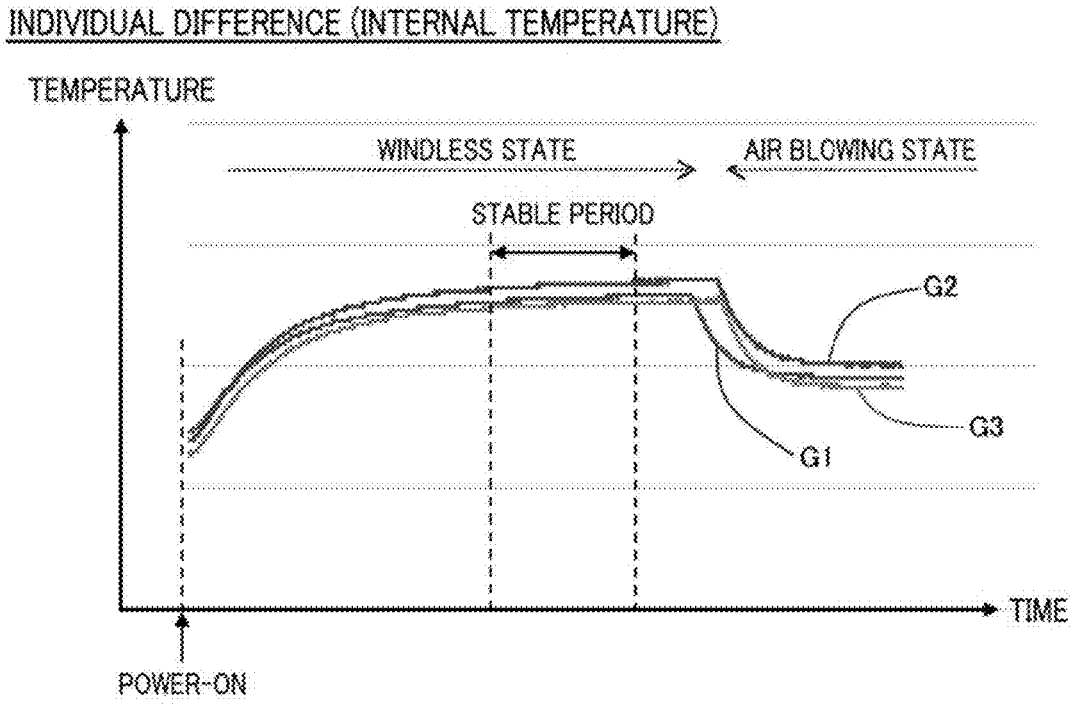
FIG. 9A is a diagram showing an example of individual differences in internal temperatures.
FIG. 9B is a diagram showing an example of individual differences in internal temperatures.

Further, as shown in FIGS. 9A and 9B, a result of measuring the internal temperatures of the respective controllers 1 shows that differences among the respective internal temperatures are less than 1 degree (Fahrenheit), in other words, an influence of the individual differences of the controllers 1 on the internal temperature are very small. Further, in the stable period and the air blowing state in which air blowing is started, the internal temperatures and the temperature differences during air blowing are also found to be substantially the same among the respective controllers 1. Although FIGS. 9A and 9B show the measurement results for three controllers 1 for simplicity of illustration, similar tendencies are statistically confirmed in the tests conducted.

As described above, it is considered that the difference between the measurement results of the internal temperature sensor 8 and the measurement results of the heat source temperature sensor 9 is caused by the individual differences in heat generation of the control unit 3 which is the heat source. Further, the individual differences are found to be linked to the temperature differences between immediately after power on and the stable period shown in FIGS. 8A and 8B, that is, the individual differences are generally offset.

As a result, it is considered that the measurement results of the heat source temperature are different among different controllers 1. In addition, when a temperature sensor built in the control unit 3 is used as the heat source temperature sensor 9, for example, it is assumed that differences in measurement results may occur due to similar individual differences.

As seen from FIGS. 8A, 8B, 9A and 9B, the internal temperature is found to be hardly affected by the individual differences. Further, as seen from the shapes of graphs corresponding to G1 to G3 shown in FIG. 8A, the influence of the individual differences on the heat source temperature appears as offset values, in which the measurement values are increased or decreased overall. Therefore, it is considered that determining an offset value of each controller 1 enables to suppress the influence of the individual differences among the controllers 1.

In other words, it is considered that, if the differences in heat source temperature caused by the individual differences can be corrected in some way, the same correction associated with the individual differences can be applied to the controllers 1. Therefore, in the present embodiment, the differences in heat source temperature caused by the individual differences are corrected to thereby prevent errors in calculated temperatures.

Figure 10:
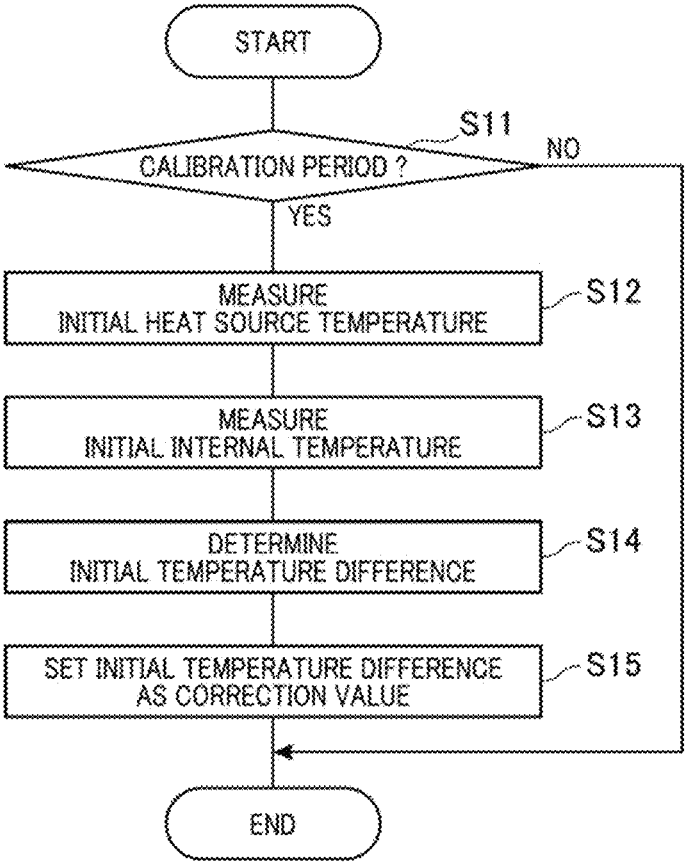
FIG. 10 is a flowchart of a process for determining a correction value.

Specifically, as shown in FIG. 10, the controller 1 determines whether it is a calibration period in step S11. In the present embodiment, a predetermined period immediately after power on is set as the calibration period. Since the predetermined period immediately after power on is a period immediately after the control unit 3 as the heat source is activated, it is considered that an influence of heat generated by the control unit 3 on the heat source temperature is very small.

Further, it is considered that the internal temperature immediately after power on substantially corresponds to room temperature. Since the calibration period is a period before air-conditioning control is performed and in which air blowing is not yet started, it is considered that an influence of air blowing is small. Further, as shown in FIGS. 9A and 9B, it is found that the internal temperature is not much affected by the individual differences. Therefore, it is considered that the heat source temperature and the internal temperature measured in the calibration period can be used as references for correcting the individual differences.

When it is a calibration period (YES in step S11), the controller 1 measures an initial heat source temperature in step S12, and measures an initial internal temperature in step S13. The initial heat source temperature refers to a heat source temperature measured in the calibration period, and the initial internal temperature refers to an internal temperature measured in the calibration period. Steps S12 and S13 can be executed in any order.

Then, the controller 1 obtains an initial temperature difference, which is a temperature difference between the initial heat source temperature and the initial internal temperature, in step S14, and set the obtained initial temperature difference as a correction value for correcting the heat source temperature to obtain a calculated temperature in step S15. The correction value is obtained by subtracting the initial heat source temperature from the initial internal temperature as follows:

$$\text{Correction value} = \text{Initial internal temperature} - \text{Initial heat source temperature}$$

As can be understood from FIG. 5, the above correction value is obtained as a value in which the influence of room temperature is excluded, that is, a value independent from the environment where the controller 1 is installed. In addition, the correction value is obtained as the amount of difference between a value that should be common among the controllers 1 and the actual value of each controller 1, that is, the offset value described above.

After the correction value is obtained, the controller 1 determines the room temperature generally according to the flow shown in FIG. 4. Specifically, the controller 1 measures the heat source temperature (T1) in step S1, and corrects the measured heat source temperature (T1) using the correction value. In the present embodiment, a corrected heat source temperature is obtained by adding the correction value to the measured temperature as follows.

Corrected heat source temperature=Measured heat source temperature+Correction value Then, the controller 1 determines an internal temperature in step S2, determines a temperature difference between the corrected heat source temperature and the internal temperature in step S3, determines an increase amount of the internal temperature in step S4, and determines a room temperature in step S5. That is, the controller 1 corrects the heat source temperature used for determining an amount of increase in the internal temperature using the correction value obtained at the time of power-on.

Figure 11A:
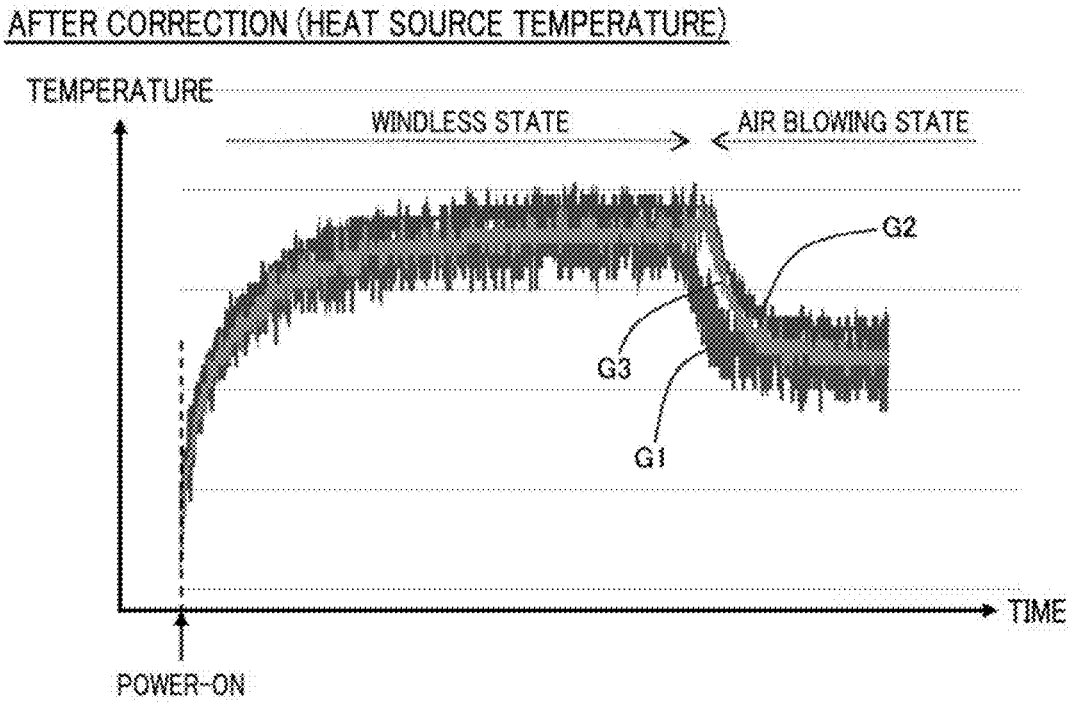
FIG. 11A is a diagram showing an example of heat source temperatures and calculated temperatures after correction.
Figure 11B:
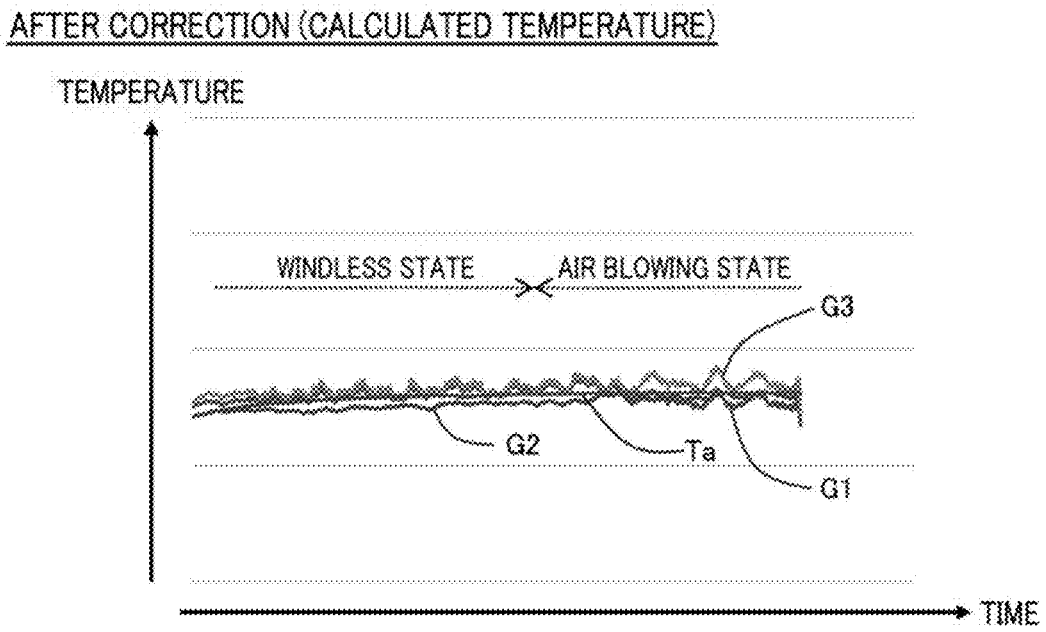
FIG. 11B is a diagram showing an example of heat source temperatures and calculated temperatures after correction.

FIG. 11A shows the corrected heat source temperature obtained by correcting the heat source temperature using the correction value, and the FIG. 11B shows the calculated temperature obtained based on the corrected heat source temperature. As shown in FIG. 11A in the controllers 1 denoted as G1 to G3, the measurement values are decreased overall when the offset value is negative, and the measurement values are increased overall when the offset value is positive. As a result, it is found that the corrected heat source temperatures of the controllers 1 substantially overlap each other, that is, the individual differences are removed.

Further, it is also found that, in the controllers 1 denoted as G1 to G3, a difference between the calculated temperature obtained based on the corrected heat source temperature and the room temperature (Ta) is within approximately 1 degree (Fahrenheit). That is, it is found that an appropriate room temperature can be obtained, by correcting the heat source temperature measured during operation as described above. Accordingly, in step S6, the controller 1 can appropriately perform air-conditioning control according to the calculated temperature obtained based on the corrected heat source temperature.

As described above, the controller 1 corrects the heat source temperature used for determining an amount of increase in the internal temperature. Further, the controller 1 obtains a difference in heat source temperature caused by the individual differences during the calibration period after power on, and corrects the heat source temperature using the difference. As a result, it is possible to reduce errors caused by individual differences among the electrical components such as a heat source and a temperature sensor. Further, it is also possible to obtain a correction value at a plurality of times in a very short period of time during the calibration period to thereby improve validity or accuracy of the correction value.

Since the heat source temperature is measured as room temperature+$\alpha$ and the internal temperature is measured as room temperature+$\beta$ as shown in FIG. 5, the influence of the room temperature can be excluded from the correction value by obtaining the correction value by subtracting the initial heat source temperature from the initial internal temperature. Therefore, an appropriate correction value can be obtained regardless of the installation environment of the controller 1 or even after the controller 1 is installed. In this case, since the calibration period immediately after power on is considered not to be the air blowing state, the correction value can be appropriately obtained without being affected by an air flow.

Further, since the individual differences can be removed during operation, that is, after the controller 1 is installed, and the correction can be made by excluding the influence of the room temperature, an influence coefficient can be obtained at a certain room temperature in a preliminary test. Therefore, it is not necessary to conduct tests at different room temperatures, which significantly improves operation efficiency of the preliminary test and manufacturing efficiency of the controller 1, and contributes to the cost reduction.

Further, even when individual differences of the heat sources or the temperature sensors change due to aging, such changes in individual differences can be removed in obtaining the correction value since the correction value is obtained during the calibration period. Therefore, it is possible to perform appropriate correction over a long period of time, that is, the quality of the controller 1 can be ensured over a long period of time.

The present disclosure is not limited to the embodiment described above or illustrated in the drawings, and can be modified or extended without departing from the spirit thereof. Such modifications and extensions are included in the scope of equivalence.

For example, in the configuration described in the embodiment, one internal temperature sensor 8 is provided. However, a plurality of internal temperature sensors 8 may also be provided. In this case, the plurality of internal temperature sensors 8 are used to obtain respective room temperatures, and the room temperature values are averaged or values considered to be errors are excluded from the room temperature values. Accordingly, the precision or accuracy in the room temperature can be improved. That is, an appropriate room temperature can be obtained.

While the control unit 3 is assumed to be the heat source in the embodiment, other heat sources such as a back panel may also be provided in the housing 2. In this case, a portion of the housing 2 in which the temperature rises to the highest value, and a portion away from that portion and in which a significant temperature difference is achieved can be determined by thermal design or the like. The internal temperature sensor 8 can be provided in the portion in which a significant temperature difference is achieved to thereby determine room temperature in the same manner as in the embodiment.

While the embodiment has been described using the example in which Fahrenheit is used, Celsius may also be used. The controller 1 can obtain a calculated temperature using the same influence coefficient (k) obtained by a preliminary test even when the heat source temperature and the internal temperature change in the windless state and the air blowing state, or even when the room temperature itself changes in the windless state or the air blowing state. The calculated temperature substantially matches the actual room temperature, and the room temperature can be appropriately obtained.

What is claimed is:

1. A controller for an air conditioner that performs air-conditioning according to room temperature, the controller comprising:

a housing;

a heat source temperature sensor disposed inside the housing, the heat source temperature sensor being configured to measure a temperature of a heat source that generates heat during operation as a heat source temperature;

an internal temperature sensor disposed inside the housing at a position away from the heat source, the internal temperature sensor being configured to measure a temperature inside the housing as an internal temperature; and a control unit that determines the room temperature using a temperature difference between the measured heat source temperature and the measured internal temperature.

2. The controller according to claim 1, wherein the control unit determines an amount of increase in the internal temperature caused by an influence of heat generated by the heat source relative to the room temperature using a temperature difference between the heat source temperature and the internal temperature, and determines room temperature using the determined amount of increase.

3. The controller according to claim 1, wherein the control unit determines an amount of increase in the internal temperature using an influence coefficient and a temperature difference between the heat source temperature and the internal temperature, the influence coefficient being obtained in advance as a ratio of a temperature difference between a heat source temperature measured at a known room temperature and the known room temperature to a temperature difference between an internal temperature measured at the known room temperature and the known room temperature.

4. The controller according to claim 3, wherein room temperature determined using the influence coefficient is within a temperature range regarded as room temperature.

5. A controller for an air conditioner that performs air-conditioning according to room temperature, the controller comprising:

a housing;

a heat source temperature sensor disposed inside the housing, the heat source temperature sensor being configured to measure a temperature of a heat source that generates heat during operation as a heat source temperature;

an internal temperature sensor disposed inside the housing at a position away from the heat source, the internal temperature sensor being configured to measure a temperature inside the housing as an internal temperature; and a control unit that controls the air conditioner according to the room temperature of a room which the housing is disposed, wherein the control unit determines a correction value using a temperature difference between a heat source temperature measured at a predetermined calibration period after power on and the internal temperature, corrects a heat source temperature used when determining an amount of increase in the internal temperature using the correct value, determines the amount of increase in the internal temperature caused by an influence of heat generated by the heat source relative to the room temperature using a temperature difference between the corrected heat source temperature and the internal temperature, and determines the room temperature using the determined amount of increase.

* * * * *